United States Patent [19]

Takeda et al.

[11] Patent Number: 4,902,597

[45] Date of Patent: Feb. 20, 1990

[54] CARRIER FOR ELECTROPHOTOGRAPHIC DEVELOPER

[75] Inventors: Masayuki Takeda; Masao Mochizuki; Koichi Kumashiro; Ikutaroh Nagatsuka; Masayoshi Shinoki; Takayoshi Aoki, all of Kanagawa, Japan

[73] Assignee: Fuji Xerox Co., Ltd., Tokyo, Japan

[21] Appl. No.: 216,055

[22] Filed: Jul. 7, 1988

[30] Foreign Application Priority Data

Jul. 8, 1987 [JP] Japan ..... 62-168802

[51] Int. Cl.[4] ..... G03G 9/14

[52] U.S. Cl. ..... 430/106.6; 430/108; 430/111

[58] Field of Search ..... 430/108, 111, 106.6

[56] References Cited

U.S. PATENT DOCUMENTS 4,254,203 3/1981 Oka et al. ..... 430/111 X
4,414,322 11/1983 Miyakawa et al. ..... 430/108 X

FOREIGN PATENT DOCUMENTS 54-24632 2/1979 Japan .
60-79361 5/1985 Japan ..... 430/106.6
61-57633 12/1986 Japan ..... 430/106.6
62-229161 10/1987 Japan ..... 430/108

OTHER PUBLICATIONS

Chemical Abstracts vol. 99, 1983, p. 576, Abstract No. 99:80018.

*Primary Examiner*—Paul R. Michl
*Assistant Examiner*—Jeffrey A. Lindeman
*Attorney, Agent, or Firm*—Finnegan, Henderson, Farabow, Garrett and Dunner

[57] ABSTRACT

A negative charging carrier for an electrophotographic developer is described, comprising a binder resin having dispersed therein a magnetic powder, wherein said carrier contains a fluorine-containing resin fine powder in an amount of from 5 to 50% by weight based on the total weight of the carrier. The carrier provides a developer for magnetic brush development having a prolonged life and a high rate of development.

4 Claims, No Drawings

CARRIER FOR ELECTROPHOTOGRAPHIC DEVELOPER

The present invention relates to a carrier of a two-component developer used for developing an electrostatic or magnetic latent image in electrophotography, electrostatic recording, electrostatic printing, and the like, and more particularly, to a carrier having particles of a magnetic substance dispersed therein.

BACKGROUND OF THE INVENTION

In electrophotography, an electrostatic latent image is formed by various means on a photoreceptor comprising a photoconductive substance, such as selenium, and a toner is deposited on the latent image by magnetic brush development or a similar technique to thereby develop the latent image for visualization.

In the development processing, particles of a carrier are used to impose an appropriate level of positive or negative electrical charge on the toner particles. Various types of carriers have so far been developed and put into practical use.

Among the various performance characteristics required for the carrier, particularly important are appropriate charging properties, impact resistance, abrasion resistance, developing properties and working life of a developer containing the carrier. Taking these required performances characteristics into consideration, conventional carriers need to be improved, since none of them is entirely satisfactory. For example, although conductive carriers, such as an iron oxide powder, are superior in solid developability, they are inferior in reproducibility of fine lines and, in addition, they require the presence of a special charge control agent in order to obtain a prolonged life of the developer. On the other hand, coated insulating carriers are excellent in working life and fine line reproducibility but are poor in solid reproducibility.

In an attempt to overcome these disadvantages, small-sized carriers comprising a binder resin having magnetic fine powders dispersed therein, i.e., so-called microtoning carriers (i.e., a two component developer comprising a carrier having a small particle size of 5 to 30 μm in which the magnetic fine powder is dispersed in the binder resin, and a toner) as described in JP-A-54-24632 (the term "JP-A" as used herein means an "unexamined published Japanese patent application) have been proposed and put into practical use. However, such carriers tend to adhere to the photoreceptor because of their small particle size. Moreover, magnetic particles released from the surface of the carrier cause variations in the quantity of electric charge due to environmental changes between high and low humidity, and also a large increase in carrier life cannot be achieved due to difficulty in treating the carrier surface.

SUMMARY OF THE INVENTION

Accordingly, one object of the present invention is to provide a novel carrier for use in a magnetic brush development system for developing an electrostatic latent image in electrophotography, electrostatic recording, and the like.

Another object of the present invention is to provide a carrier for magnetic brush development, which imposes a large quantity of electric charge on a toner and which provides a developer having a prolonged life and a high rate of development.

The inventors have conducted extensive investigations of conventional carriers and have found the above-described disadvantages associated with them. As a result, it has now been found that improvements in the above-described characteristics required for a carrier can be achieved by using a magnetic fine powder-dispersed type carrier containing a specific resin fine powder.

In accordance with the present invention, there is provided a negative charging carrier for an electrophotographic developer comprising a binder resin having dispersed therein a magnetic powder, wherein said carrier further contains a fluorine-containing resin fine powder in an amount of from 5 to 50% by weight based on the total weight of the carrier.

DETAILED DESCRIPTION OF THE INVENTION

Conventional binder resins can be used in the present invention, and in general, a thermoplastic resin may be employed. Specific examples of usable resins include homo- or copolymers of styrene compounds, e.g., styrene chlorostyrene, and vinyl-styrene; monoolefins, e.g., ethylene, propylene, butylene, and isobutylene; vinyl esters, e.g., vinyl acetate, vinyl propionate, vinyl benzoate, and vinyl butyrate; α-methylene aliphatic monocarboxylic acid esters, e.g., methyl acrylate, ethyl acrylate, butyl acrylate, dodecyl acrylate, octyl acrylate, phenyl acrylate, methyl methacrylate, ethyl methacrylate, butyl methacrylate, and dodecyl methacrylate; vinyl ethers, e.g., vinyl methyl ether, vinyl ethyl ether, and vinyl butyl ether; and vinyl ketones, e.g., vinyl methyl ketone and vinyl hexyl ketone, vinyl isopropenyl ketone. Typically, resins such as polystyrene, a styrene-alkyl acrylate copolymer, a styrene-alkyl methacrylate copolymer, a styrene-acrylonitrile copolymer, a styrene-butadiene copolymer, a styrene-maleic anhydride copolymer, and the like can be preferably used.

In addition, polyester, polyuretane, epoxy resins, silicone resins, polyamide, modified rosin, paraffin, and waxes can also be used as binders.

The binder resins which can be used in the present invention are generally used in an amount of generally from about 5 to 55 wt% and preferably from 25 to 50 wt%, of the total weight of the carrier particles.

The magnetic fine powder to be dispersed in the binder resin may be any of ferromagnetic powders commonly employed in the art, such as tri-iron tetraoxide, γ-di-irontrioxide, various ferrite powders, chromium oxide, magnetite various metal fine powders, and the like.

The average particle diameter of the magnetic powders is preferably from 0.05 to 5 μm and more preferably from 0.1 to 2 μm.

The magnetic powders which can be used in the present invention are generally used in an amount of generally from about 45 to 95 wt % and preferably from 50 to 75 wt %, of the total weight of the carrier particles.

The fluorine-containing resin to be incorporated into the carrier in the form of a fine powder preferably includes polymers containing fluorine in the main chain thereof, such as homo-polymers of tetrafluoroethylene, trifluoroethylene, vinylidene fluoride, monofluoroethylene, hexafluoropropylene, and the like, as well as copolymers of the monomers of the above, and ethylene, propylene, butylene, vinyl chloride, vinylidene chloride, trifluoroethylene, and other co-polymerizable monomers containing an unsaturated bond. Among these, a polymer of vinylidene fluoride is preferred.

The fine powder (primary particle) of the fluorine-containing resin suitably preferably has an advantage particle diameter in the order of submicrons to several microns. That is, the average particle diameters of the fluorine-containing resin fine powder is preferably from 0.01 to 10 μm and more preferably from 0.1 to 5 μm.

The proportion of the fluorine-containing resin fine powder in the total carrier preferably ranges from 5 to 50% by weight, preferably from 5 to 30% by weight and more preferably from 5 to 20% by weight, though varying somewhat depending on the kind of resin. When it is less than 5% by weight, pulverization, employed in the preparation of the carrier, may become difficult. Also, the resulting carrier cannot be sufficiently charged, and there is a poor effect on prolonging the life of the developer. On the other hand, if the amount exceeds 50% by weight, the quantity of electric charge imposed may become too large, depending on the kind of toner used in combination, and this results in forming a low density image. The magnetic powder is preferably used in an amount ranging from about 30% to about 95% by weight, more preferably from 45% to 90% by weight, based on the total weight of the carrier.

For the purpose of controlling charge quantity, improving dispersability, strength and powder fluidity, and the like, the carrier according to the present invention may further comprise various internal additives, such as other resins, charge controlling agents, coupling agents, fillers, and other fine powders in addition to the binder resins, magnetic powder and fluorine-containing resin fine powder.

The carrier of the present inventiõn may be produced by various methods, such as a method comprising melt-kneading the above-described components by means of a heat mixing machine, e.g., a kneader, a Banbury mixer, or other similar mixer, and pulverizing the mixture, followed by classification. For example, the binder resin, the fluorine-containing resin powder and the magnetic powder may be melt-kneaded by means of a Banbury mixer, a kneader, a roll mill, an extruder, or the like, and the mixture is then cooled, pulverized, and classified. The carrier can also be obtained by a spray drying method comprising dispersing the magnetic powder in a resin solution followed by spray drying, or a suspension polymerization method comprising dispersing a monomer(s) constituting the binder resin and prescribed other materials in an appropriate solvent followed by suspension polymerization. The particle size of the carrier can be adjusted by controlling conditions for pulverization after melt-kneading, or by classification, or by mixing two or more kinds of previously prepared carriers having different particle size distributions to obtain a mixed carrier having a desired particle size distribution. In view of a balance of performance characteristics, such as the life of the developer, protection of the carrier from adhesion onto a photoreceptor and image quality, the carrier particles according to the present invention preferably have an average particle diameter of from 10 to 400 μm, more preferably from 30 to 200 μm, and most preferably from 30 to 100 μm.

The thus obtained carrier of the present invention is mixed with a toner to provide a developer for maghetic brush development for use in development of an electrostatic latent image.

The toners which are suitable for use with the above carrier include any electrical charging toners used in general electrophotography, which comprise a binder resin having dispersed therein a colorant. Since the carrier of the present invention comprises a binder resin having dispersed therein a fluorinecontaining resin fine powder and a magnetic powder, the charging properties thereof can be controlled by selecting the kind and the amount of the fluorine-containing resin to be used. Also, the kind and amount of such resin can be selected to prolong the life of the carrier itself, which ultimately leads to a prolonged life of the developer.

The present invention is now illustrated in greater detail with reference to Examples and Comparative Examples, but it should be understood that the present invention is not deemed to be limited thereto. In these Examples, all the parts, percents, and ratios are by weight unless otherweise indicated.

EXAMPLE 1

| | |
|---|---|
| Magnetite ("EPT 1000" produced by Toda Kogyo Co., Ltd., average particle diameter: 0.35 μm) | 70 parts |
| Styrene/n-butylmethacrylate copolymer (85/15) | 24 parts |
| Polyvinylidene fluoride "KYNAR", produced by Pennwalt Co., Ltd.) | 6 parts |

The above components were melt-kneaded in a pressure kneader, the mixture was pulverized by means of a turbo-mixer and the particles were classified by means of a sifting machine to obtain a carrier having an average particle diameter of 60 μm.

EXAMPLE 2

| | |
|---|---|
| Magnetite ("EPT 1000") | 70 parts |
| Styrene/n-butylmethacrylate copolymer (85/15) | 24 parts |
| Tetrafluoroethylene ("Rublon" produced by Daikin Kogyo Co., Ltd.) | 6 parts |

The above components were kneaded, pulverized and classified in the same manner as in Example 1 to obtain a carrier having an average particle diameter of 60 μm.

COMPARATIVE EXAMPLE 1

| | |
|---|---|
| Magnetite ("EPT 1000") | 70 parts |
| Styrene/n-butylmethacrylate copolymer | 30 parts |

The above components were kneaded, pulverized, and classified in the same manner as in Example 1 to obtain a carrier having an average particle diameter of 60 μm.

COMPARATIVE EXAMPLE 2

| | |
|---|---|
| Magnetite ("EPT 1000") | 140 parts |
| Styrene/n-butylmethacrylate copolymer | 51 parts |
| Polyvinylidene fluoride ("KYNAR") | 9 parts |

The above components were kneaded, pulverized, and classified to obtain a carrier having an average particle diameter of 60 μm.

Each of the carriers obtained in Examples 1 and 2 and Comparative Examples 1 and 2 was mixed with a toner for a copying machine "FX-7770" (manufactured by Fuji Zerox Co., Ltd.) which comprised a styrene-acrylate resin and carbon black and had an average particle diameter of 11 μm to prepare a developer having a toner concentration of 3%. The resulting developer was designated as Developer 1, 2, 3, or 4, respectively.

Each resulting developer was loaded in a bench machine for evaluation, and copying was carried out at a photoreceptor speed of 350 mm/sec. and a developing magnetic roll (sleeve) speed of 550 mm/sec. The quantities of charge in the initial stage of copying and after running 100,000 times were measured for each developer. The results obtained are shown in Table 1 below.

TABLE 1

| Developer No. | Carrier | Quantity of Charge (uc) Initial Stage | After Running 100,000 Times |
|---|---|---|---|
| 1 | Ex. 1 | 25 | 18 |
| 2 | Ex. 2 | 28 | 20 |
| 3 | Comp. Magnetite ("EPT 1000" produced | 13 | 5 |
| 4 | Comp. Ex. 2 | | 10 |

In addition, the copies obtained by using Developers 3 and 4 suffered from background stains.

While the invention has been described in detail and with reference to specific embodiments thereof, it will be apparent to one skilled in the art that various changes and modifications can be made therein without departing from the spirit of the invention, and the cope thereof is limited only by the appended claims and their equivalents.

What is claimed is:

1. A negative charging carrier for electrophotographic developer comprising particles of binder resin having dispersed therein particles of a magnetic powder having an average particle diameter of from 0.05 to 5 μm and particles of a fluorine-containing resin fine powder having an average particle diameter of 0.01 to 10 μm, said fluorine-containing resin fine powder being present in an amount of from 5 to 50% by weight, based upon the total weight of the carrier.

2. The negative charging carrier as claimed in claim 1, wherein said fluroine-containing resin fine powder is present in an amount of from 5 to 30% by weight based on the total weight of the carrier.

3. The negative charging carrier as claimed in claim 1, wherein said magnetic powder is present in an amount of from 30 to 95% by weight based on the total weight of the carrier.

4. The negative charging carrier as claimed in claim 1, wherein the average particle diameter of said carrier of from 10 to 400 μm.

* * * * *